United States Patent [19]

Ivy

[11] Patent Number: 4,926,934

[45] Date of Patent: May 22, 1990

[54] RADIATOR TANK PLATES

[76] Inventor: Eugene S. Ivy, 2247 Carrolton Dr., Southaven, Miss. 38671

[21] Appl. No.: 355,271

[22] Filed: May 22, 1989

[51] Int. Cl.[5] ..... F28F 9/02; B65D 6/36

[52] U.S. Cl. ..... 165/173; 220/73; 165/153

[58] Field of Search ..... 165/153, 173, 175; 220/73

[56] References Cited

U.S. PATENT DOCUMENTS 2,877,756 3/1959 McCauley et al. ..... 220/73 X 3,581,814 6/1971 Jackson ..... 165/134

4,380,301 4/1983 Eisman ..... 220/73

*Primary Examiner*—Martin P. Schwadron

*Assistant Examiner*—Allen J. Flanigan

*Attorney, Agent, or Firm*—John J. Mulrooney

[57] ABSTRACT

Radiator plates are contoured to fit the rims of radiator tanks where the tanks are bolted to the radiator core, and the radiator plates have bolt holes therein which align with the bolt holes in the radiator tanks and the radiator core, whereby the radiator plates may be bolted along with the tanks to the radiator core to prevent deformation and failure of the tanks and leaking of the radiator.

3 Claims, 2 Drawing Sheets

RADIATOR TANK PLATES

BACKGROUND OF THE INVENTION

This invention relates to truck radiators, and more particularly to contoured metal plates for use with tanks of truck radiators to reinforce same by providing a stronger surface on which the bolts may be tightened sufficiently to prevent leaking without deforming the tanks.

In recent years, truck manufacturers have attempted to economize on the weight and cost of the trucks by making radiator tanks with thinner metal. But while the redesigned truck radiators are lighter and less expensive, a problem has arisen due to the thin metal of the tank. The top and bottom radiator tanks must be bolted to the radiator core with bolts which fit through a plurality of holes located in a channel which surrounds the tanks. In order to withstand the high pressures in the radiator and prevent leaking, the bolts must be tightened with a substantial amount of force. Due to the thin construction of the tanks, the metal adjacent the bolts has a tendency to bend and split when subjected to the forces required to adequately tighten the bolts. This bending and splitting has the effect of providing weakened spots for leaks. Moreover, while these weakened spots may be repaired, such repairs are required more frequently and there comes a point at which the radiator may no longer be repaired and must be replaced at a substantial expense.

Therefore, an object of the invention is to provide a means for preventing radiator tanks from bending and splitting adjacent the bolts used to secure the tanks to the radiator core.

Another object of the invention is t provide reinforcing means which allow the radiator bolts to be tightened without bending and splitting the radiator tank metal.

Another object of the invention is to provide radiator plates which prevent the bending and splitting of the radiator tanks, greatly decreasing the necessity and frequency of repairs to radiator tanks, prolonging the life of radiator tanks, and decreasing the cost of operating the vehicle.

SUMMARY OF THE INVENTION

The radiator tank plates of this invention comprise metal plates contoured to fit around the edge of the upper and lower tanks and having bolt holes therein positioned to align with the bolt holes in the tanks whereby the bolts which secure the tanks to the radiator core also secure the tank plates to the core and the tanks, whereby the radiator tank plates reinforce the tank metal to prevent the tanks from bending and splitting in the spaces adjacent the bolt holes.

DESCRIPTION OF THE PREFERRED EMBODIMENTS

Figure 1:
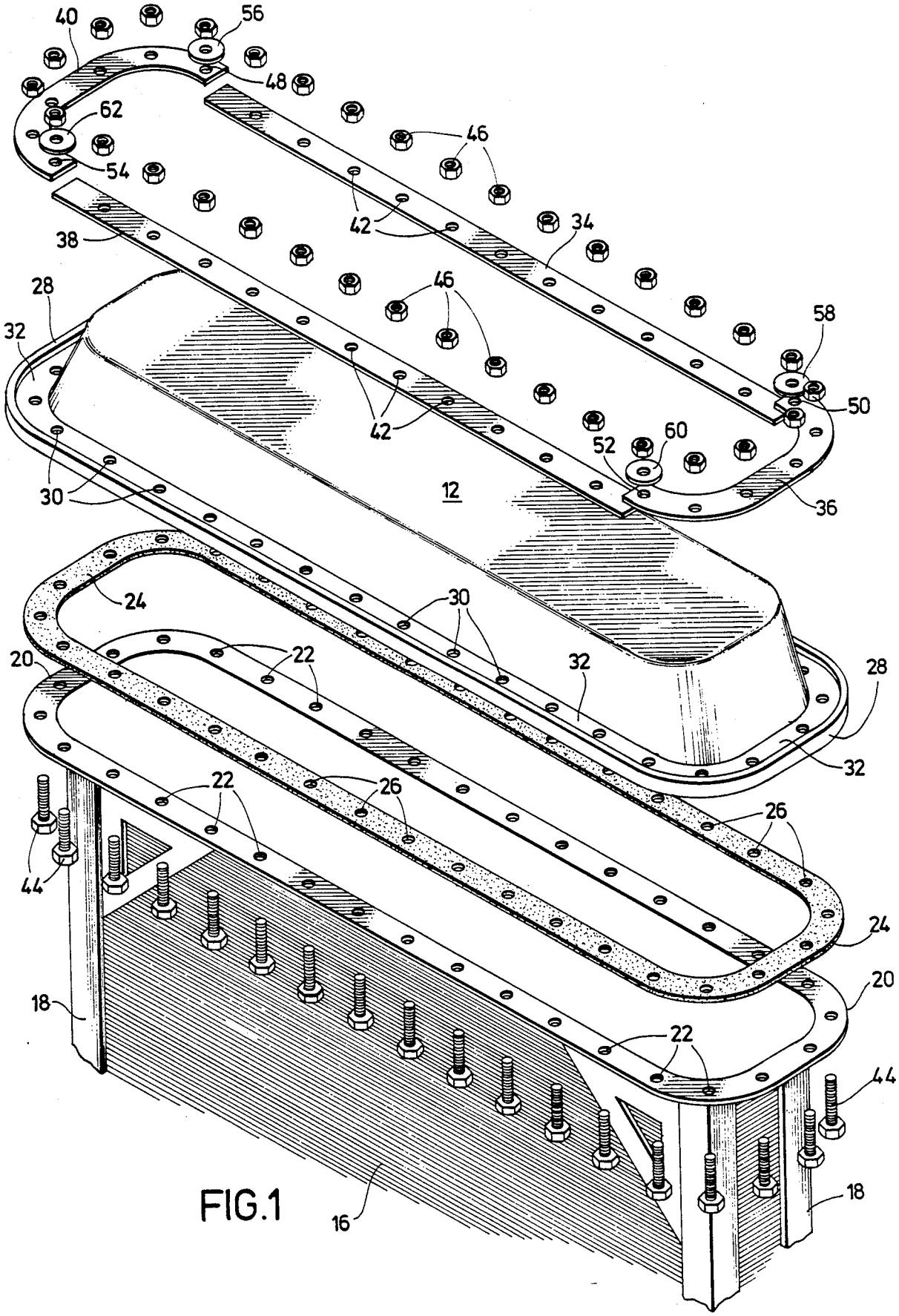
FIG. 1 is a perspective view of a conventional truck radiator, partially broken away, showing the radiator tank plates of the present invention and one of the radiator tanks in exploded format.
Figure 3:
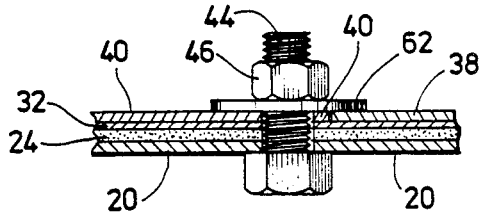
FIG. 3 is a sectional view taken along the lines 3–3 of FIG. 2.
Figure 2:
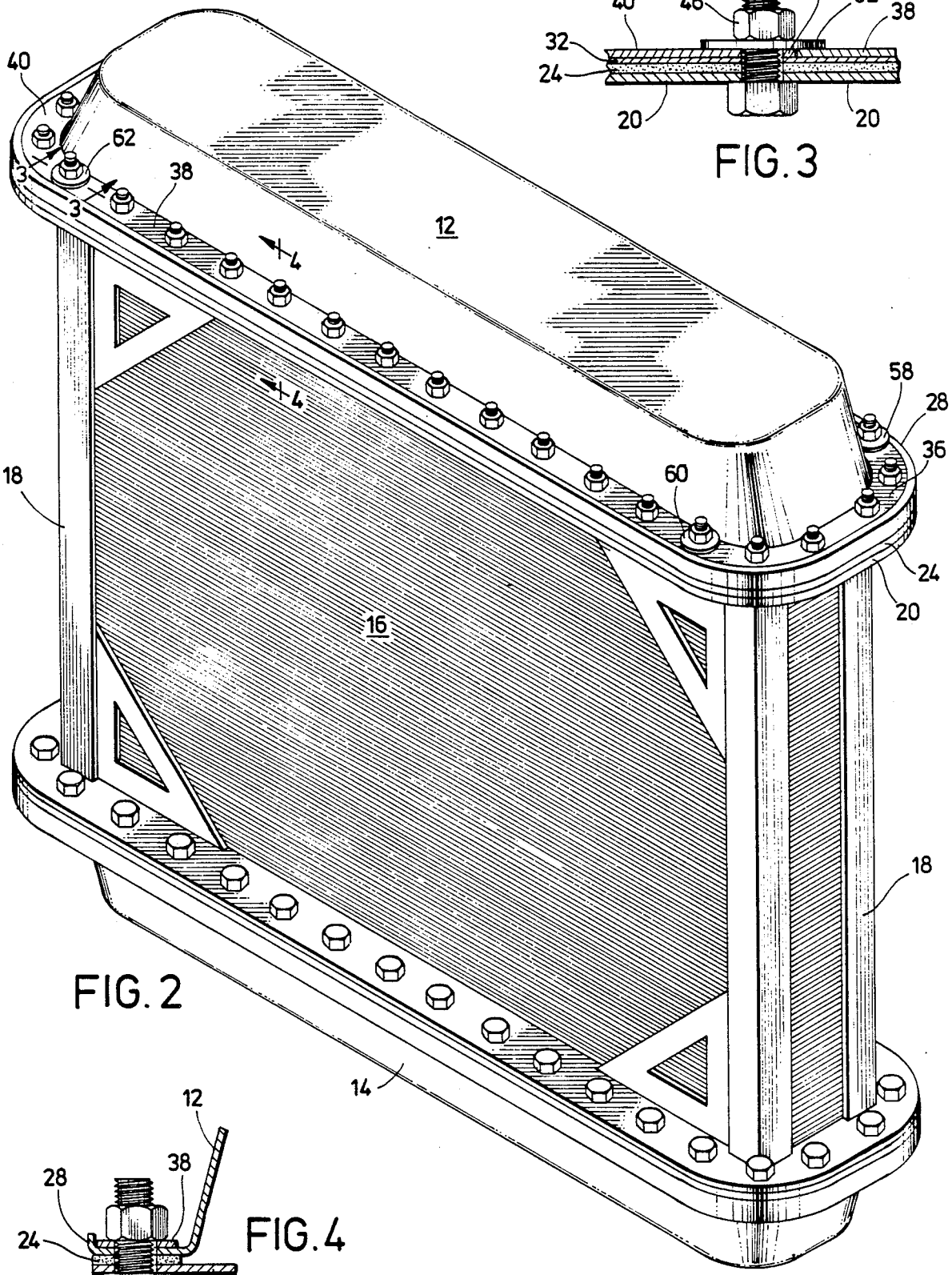
FIG. 2 is a perspective view of a conventional truck radiator showing upper and lower tank radiators in relation to the radiator core, with the radiator tank plates of the present invention mounted thereon.
Figure 4:
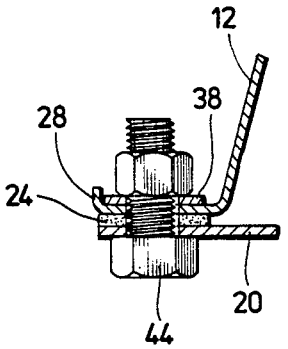
FIG. 4 is a sectional view taken along the lines 4—4 of FIG. 2.

Referring to the drawings, a conventional truck radiator is illustrated in schematic form to comprise upper 12 and a lower 14 radiator tanks mounted at the opposite ends of a radiator core 16 which has a frame 18. The customary drains, hoses, and auxiliary tanks usually found on truck radiators, but which form no part of this invention, are not illustrated.

Since the radiator tank plates which fit on either one of the radiator tanks will be positioned and will function identically to the tank plates used on the other tank, only a single set of such plates will be described in this specification, with the understanding that an identical set may be mounted with the other tank and will function in an identical manner.

The frame 18 of the radiator core 16 has a mounting surface 20 having a plurality of bolt holes 22 therein. A gasket 24 fits on the flange 20 and has a plurality of bolt holes 26 therein which are congruent with the bolt holes 22 in flange 20.

A conventional truck radiator tank 12 is designed to fit on top of flange 20 and gasket 24. The tank 12 has a circumferential mounting surface or rim 28 which has a plurality of bolt holes 30 therein. Prior to this invention, the tank 12 was bolted directly to the radiator core flange 20 by a plurality of nuts 46 and bolts 44 tightened with great force to prevent leaking. However, because of an effort to economize, the metal of the radiator tank 12, particularly at spaces 32 between the bolt holes 30 in the circumferential mounting rim 28, is relatively thin and subject t bending and splitting under the forces which must be used to tighten the bolts and nuts.

The present invention overcomes this problem by providing radiator tank plates 34, 36, 38 and 40. The tank plates are designed and contoured to fit within the tank rim 28, and have a plurality of bolt holes 42 therein which are congruent with the bolt holes in tank rim 28, gasket 24 and flange 20.

When the radiator plates are mounted in the tank rim 28, they may be secured to the radiator core by a plurality of bolts 44 and nuts 46.

In order to maintain the radiator plates in a single plane, oversized washers 56, 58, 60, and 62, are used at bolt holes 48, 50, 52, and 54, which are nearest the plate interfaces, to level the four tank plates.

The radiator tank plates of the present invention function to reinforce and strengthen the relatively weak metal in the spaces 32 between the bolt holes in the tank mounting rim 28. The radiator tank plates permit the substantial forces which are necessary to secure the tanks to the radiator core in order to prevent leaking to be applied without bending or splitting the tank metal in the spaces 32 between the bolt holes, and causing damage which either necessitates frequent repairs or greatly shortens the life of the radiator tanks.

Radiator tank plates made according to the present invention of one-eighth inch ($\frac{1}{8}''$) steel have been found to function satisfactorily to significantly decrease the frequency of repairs necessary to tank plates and to significantly decrease the failure rate of such tanks. While the radiator tank plates of the present invention illustrated in the drawings have a somewhat circular or rounded end, some conventional truck radiators have tanks with a rectangular or square shape. It will be apparent to those skilled in the art that the radiator tank plates of the present invention may be round or square as required by the design of the particular radiator tank to be reinforced.

It can be seen that the radiator tank plates of the present invention function to solve the problem of the relatively thin metal of truck radiator tanks. The present invention extends the life of radiator tanks by preventing the damage caused by the large forces which must be used to tighten the nuts and bolts in order to avoid leaking. The present invention minimizes the repairs necessary to such radiator tanks, extends the life of radiator tanks, and decreases the operational cost of vehicles which must use such tanks.

What is claimed is:

1. Apparatus for use with a radiator tank having a surface with a plurality of spaced bolt holes therein whereby said tank may be bolted to a radiator core, said apparatus comprising:

Four (4) plates, each having two ends, shaped to be superposable on said surface and having a plurality of bolt holes therein congruent with said bolt holes in said surface, whereby said tank and said plates may be bolted to said core in superposed position such that ends of adjacent plates abut; and Four (4) washers positioned at bolt holes nearest where the ends of said plates abut whereby said washers overlap the edges of adjacent plates to maintain said plates coplanar.

2. The apparatus of claim 1 wherein said surface forms a perimeter substantially rectangular in shape, having two (2) straight sides and two (2) rounded ends, and said plates comprise four (4) plates, two (2) of which are substantially straight and two (2) of which are rounded to be superposable on said surface.

3. The apparatus of claim 1 wherein said plates are made of steel having a thickness of approximately one-eighth inch ($\frac{1}{8}''$).

* * * * *